United States Patent [19]

Pitel

[11] Patent Number: 4,523,129

[45] **Date of Patent: * Jun. 11, 1985**

[54] MODULAR LIGHTING CONTROL WITH CIRCULATING INDUCTOR

[75] Inventor: Ira J. Pitel, Morristown, N.J.

[73] Assignee: Cornell Dubilier Electronics, Wayne, N.J.

[ * ] Notice: The portion of the term of this patent subsequent to Aug. 9, 2001 has been disclaimed.

[21] Appl. No.: 580,121

[22] Filed: Apr. 3, 1984

Related U.S. Application Data

[63] Continuation of Ser. No. 286,770, Jul. 27, 1981, Pat. No. 4,464,610.

[51] Int. Cl.[3] ..... H05B 41/392

[52] U.S. Cl. ..... 315/291; 315/194; 315/284; 315/308; 315/DIG. 4

[58] Field of Search ..... 315/158, 194, 199, 208, 315/247, 276, 284, 291, 307, 308, 311, DIG. 4

[56] References Cited

U.S. PATENT DOCUMENTS

| | | | |
|---|---|---|---|
| 3,878,431 | 4/1975 | Petrina | 315/199 X |
| 3,894,265 | 7/1975 | Holmes et al. | 315/194 |
| 3,935,505 | 1/1976 | Spiteri | 315/194 |
| 3,936,696 | 2/1976 | Gray | 315/224 |
| 3,991,344 | 11/1976 | Tabor | 315/198 |
| 4,001,637 | 1/1977 | Gray | 315/205 |
| 4,197,485 | 4/1980 | Nuver | 315/291 |
| 4,207,497 | 6/1980 | Capewell et al. | 315/96 |
| 4,207,498 | 6/1980 | Spira et al. | 315/97 |
| 4,464,610 | 8/1984 | Pitel | 315/291 |

*Primary Examiner*—David K. Moore
*Assistant Examiner*—Vincent DeLuca
*Attorney, Agent, or Firm*—Ronald R. Stanley

[57] ABSTRACT

The invention is directed to a circuit and a method for efficiently controlling the output illumination level in gas discharge lighting arrangements. Load side control is provided by a timed interval controlled impedance, serially coupled between the ballast and the lamp(s). A circulating inductor, coupled in parallel with the controlled impedance, provides a current path between the power source and the lamp(s) at least during that portion of the AC waveform where the controlled impedance is in a substantially non-conducting state.

8 Claims, 7 Drawing Figures

MODULAR LIGHTING CONTROL WITH CIRCULATING INDUCTOR

This application is a continuation of application serial No. 286,770, filed July 27, 1981, now U.S. Pat. No. 4,464,610.

BACKGROUND OF THE INVENTION

1. Field of the Invention

The invention relates to circuitry for controlling the output illumination level of gas discharge lamps and more particularly to circuitry having load side control and improved lamp current waveforms utilizing a circulating inductor circuit in parallel with a controlled impedance coupled between the ballast and the gas discharge lamps.

Numerous techniques have been proposed for controlling the output illumination level of gas discharge lamps. Present day objectives are directed to efficient energy use, and exemplifying such applications are control circuits for lamp dimming in response to selected illumination levels or varying secondary sources such as natural sunlight. One such system is illustrated in U.S. Pat. No. 4,197,485. Principal deficiencies impeding the development of this technology have been (1) dimming systems have, heretofore, generally reduced the net efficiency (lumen output/wattage input) of the lighting system; (2) the dimming circuitry, when sufficiently sophisticated to provide efficient dimming, becomes costly and burdensome. In contrast, the present invention is directed to a simple, yet efficient, method for illumination control of gas discharge lamps.

An alternative commonly employed to increase overall efficiency in dimming systems is to convert line frequency to higher frequencies. Illustrative of this technique are U.S. Pat. Nos. 4,207,497 and 4,207,498. In contrast, the present invention operates at line frequency. To enhance efficiency, the invention employs a novel configuration of load side control complemented by an inductive circulating current load to achieve circuit simplicity while maintaining an excellent power factor, illumination control of 10 to 1 dimming, excellent current crest factor and reduced lamp current and ballast loss. An attendant advantage of the circuit simplicity is the ready adaptation of the circuit to the physical housing of the conventional gas discharge lamp, an important economic and aesthetic concern.

SUMMARY OF THE INVENTION

The invention is directed to an apparatus and method of controlling the output illumination level of gas discharge lamps such as fluorescent lighting systems or the like. Load side control is provided by timed interval controlled impedance, serially coupled between the ballast and the lamp(s). An inductor is coupled in parallel relation to the controlled impedance. The inductor provides a current path between the power source and the lamp(s) at least during that portion of the AC waveform where the controlled impedance is in a substantially non-conductive state. The novel configuration facilitates the use of conventional magnetic ballast illumination control in a plurality of ballast/lamp arrangements, in the illumination range of 10% to 100% of full intensity illumination with substantially no reduction in the cathode heating voltage supplied to the lamp(s). An attendant advantage of the circulating inductor configuration is a reduced blocking voltage requirement for the controlled impedance, further simplifying component requirements.

BRIEF DESCRIPTION OF THE DRAWINGS

In the drawings, where like components bear common reference designation.

DETAILED DESCRIPTION OF THE INVENTION

Figure 1:
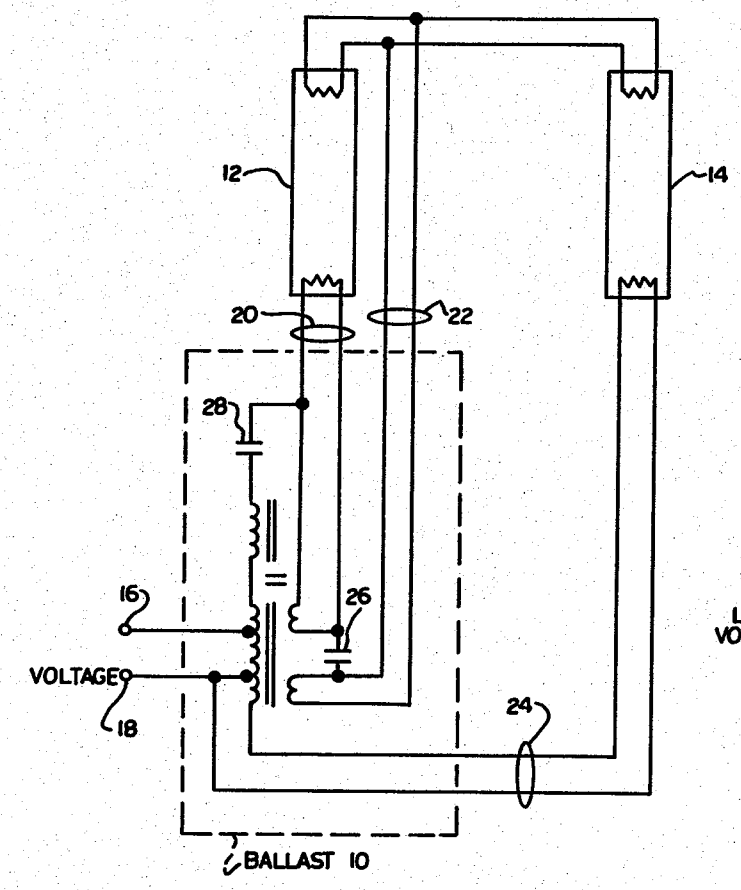
FIG.1 (PRIOR ART)
FIG. 1 illustrates a conventional magnetic ballast two-lamp fluorescent lighting system.

Referring to the drawings, FIG. 1 is a conventional fluorescent lighting installation serving as a basis for illustrating the novel characteristics of the present invention. A standard magnetic ballast 10, which is essentially a complex transformer wound on an iron core, drives the serially connected gas discharge (fluorescent type) lamps 12 and 14. As used in FIG. 1, ballast 10 includes lead pairs 20, 22 and 24, each of which is driven from a small winding in ballast 10. The ballast also includes a starting capacitor 26 and a series capacitor 28 which serves to correct for power factor. In operation, the lead pairs 20, 22 and 24 provide heating current for the cathodes, a, of the lamps 12 and 14, and the power for driving the lamps in series is provided between the leads 24 and 20.

Figure 2:
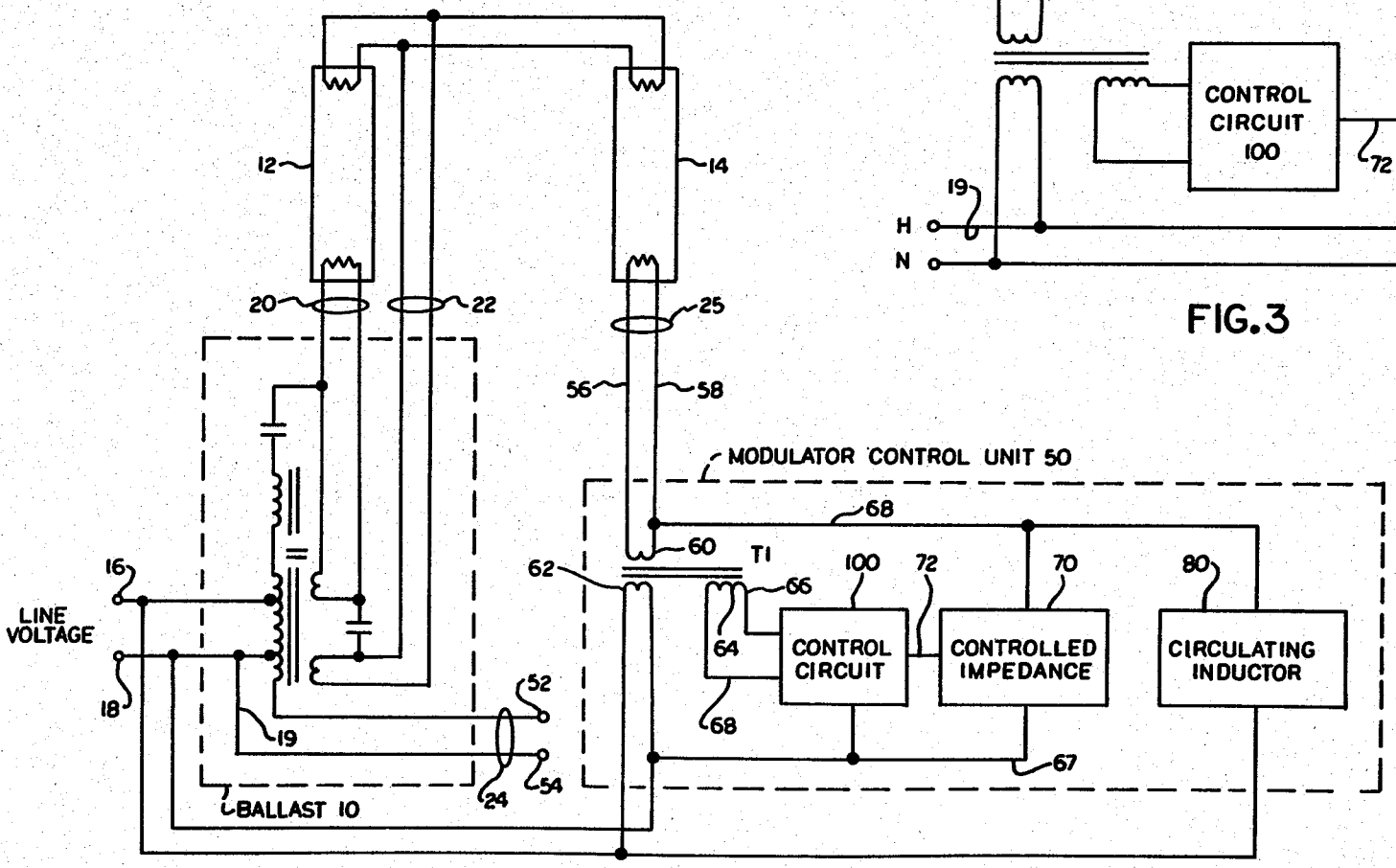
FIG. 2 illustrates, in partially schematic, partially block diagram format, the illumination control system of the present invention.

FIG. 2 illustrates one embodiment of the gas discharge lighting control apparatus of the present invention. To facilitate illustration, conventional fluorescent lamps are used as a specific embodiment of the gas discharge lamp(s), noting however the applicability of the invention to other gas discharge lamps including mercury vapor, sodium vapor, and metal halide.

A standard ballast arrangement 10 is substantially identical to the conventional ballast described heretofore. A modular control unit (MLC) 50 is serially interposed between the ballast 10 and the lamps 12, 14. The modular control unit may be conveniently wired into the conventional circuit arrangement by decoupling cathode leads 24 and connecting MLC leads to 16 and 18. The MLC output leads 56, 58 are then coupled to the cathode lead pair 25.

Energy to heat the lower cathode of lamp 14 is coupled from leads 16 and 18 through the windings 62 and 60 to lead 25. Windings 62 and 60 therefore preferably include a different number of turns, so that the voltage across lead 25 receive the same heater signal as it did in FIG. 1. (This voltage would typically be about 3.6 volts.) Winding 64 should include a larger number of turns than winding 60 in order to achieve a step up of voltage. In a conventional 120 volt system, winding 64 preferably provides about 18 volts AC between the leads 66 and 68. This 18 volt signal serves as a power source for control circuit 100, discussed hereinafter.

The modular control unit 50 broadly comprises a transformer $T_1$, including windings 60, 62 and 64; a controlled impedance 70 having a main current conduction path coupled across the transformer $T_1$; a circulating inductor 80 coupled in parallel relationship with said controlled impedance and line voltage; a control circuit 100 powered from a separate winding 66 of $T_1$ and providing a time duration controlled drive signal to the control electrode 72 of impedance 70. In practice, control circuit 100 is effective to drive impedance 70 into or from a conductive state during a controlled portion of each half cycle of the AC line voltage.

Controlled impedance 70 is preferably a controlled switch which can provide either an open circuit or a short circuit between leads 67 and 68 (and therefore between terminals 18 and 58), depending upon a control signal provided on lead 72 by control circuit 100. It will be appreciated that the state of controlled impedance 70 (conductive or non-conductive) will determine whether the lamp current flows through the controlled impedance 70 or is circulated through inductor 80. When controlled impedance 70 in conductive there exists a series circuit between the ballast and lamps applying operating current to the lamps. When impedance 70 in non-conductive, operating lamp current is circulated through inductor 80, the effect of which is detailed hereinafter.

Figure 3:
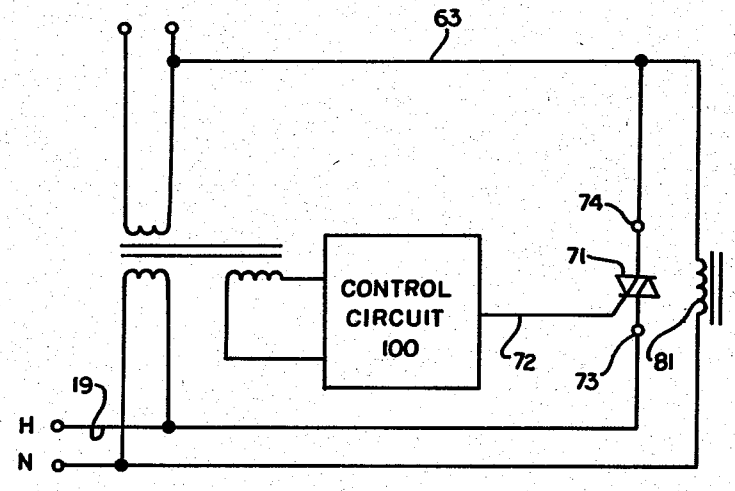
FIG. 3 illustrates a particular embodiment of the present invention.

Referring to FIG. 3, the controlled impedance 70 preferably comprises a TRIAC 71 having its main current conduction path coupled between line voltage tap 19 and the gas discharge lamps 12 and 14 and its control or gate electrode 72 coupled to the output of the control circuit 100.

In the absence of an activating signal at gate 72, TRIAC 71 presents a very high impedance between terminals 73 and 74. When an activating (triggering) signal is applied to gate 72, TRIAC 71 turns on, thereby presenting a low impedance (i.e., it becomes conductive) between terminals 73 and 74. Thereafter, the TRIAC remains conductive until the current flowing through it fails to exceed a predetermined exinguishing current. A TRIAC conducts in both directions upon being triggered via gate 72. However, unless the trigger signal is maintained on the gate, the TRIAC will turn off during each cycle of an AC signal applied between the main terminals, since the current flow will drop below the extinguishing current when the AC signal changes direction. In a preferred embodiment, TRIAC 71 is, therefore, retriggered during every half cycle of the power signal. By varying the delay before re-triggering occurs, it is then possible to control the proportion of each half cycle over which TRIAC 71 conducts, and thereby the overall power delivered to the lamps 12 and 14 via lead 68.

Conventional lead type magnetic ballasts achieve high power factor by providing high primary magnetization current to compensate for the leading component of lamp current.

With thyristor control on the load side of the ballast without the circulating inductor, the internal series inductor and capacitor of the ballast resonate at their natural frequency. This results in higher than normal harmonic currents and a lagging fundamental lamp current. The use of a high primary magnitization current further reduces power factor and degrades ballast performance. One means typically used to improve the input current waveform would be added capacitance at the input of the ballast. This reduces the lagging magnetization current, but leaves the higher than normal harmonic currents. Using a conventional ballast, the present invention requires substantially less input capacitance to achieve 90% power factor, typically about 4–6 microfarads. Furthermore, the invention teaches a circuit configuration having a significantly reduced magnetization current without the addition of input capacitance. In one embodiment, magnetization current is lowered by interleaving the ballast laminations.

The present invention includes an inductor 81 which provides a circulating current to the discharge lamps 12 and 14 at least during the period during which the TRIAC is non-conducting. Using this circuit configuration lamp current now has a path to continue flowing while the TRIAC is non-conducting. The addition of the circulating inductor reduces lamp current and ballast losses, reduces blocking voltage requirements of the TRIAC and reduces the lamp re-ignition voltage. More importantly, the addition of the circulating inductor improves the lamp current crest factor (peak to rms lamp current) increasing lamp power factor.

The salient features of the inventive circuitry are best recognized by comparing voltage and current waveforms at key points in the circuit.

Figure 4:
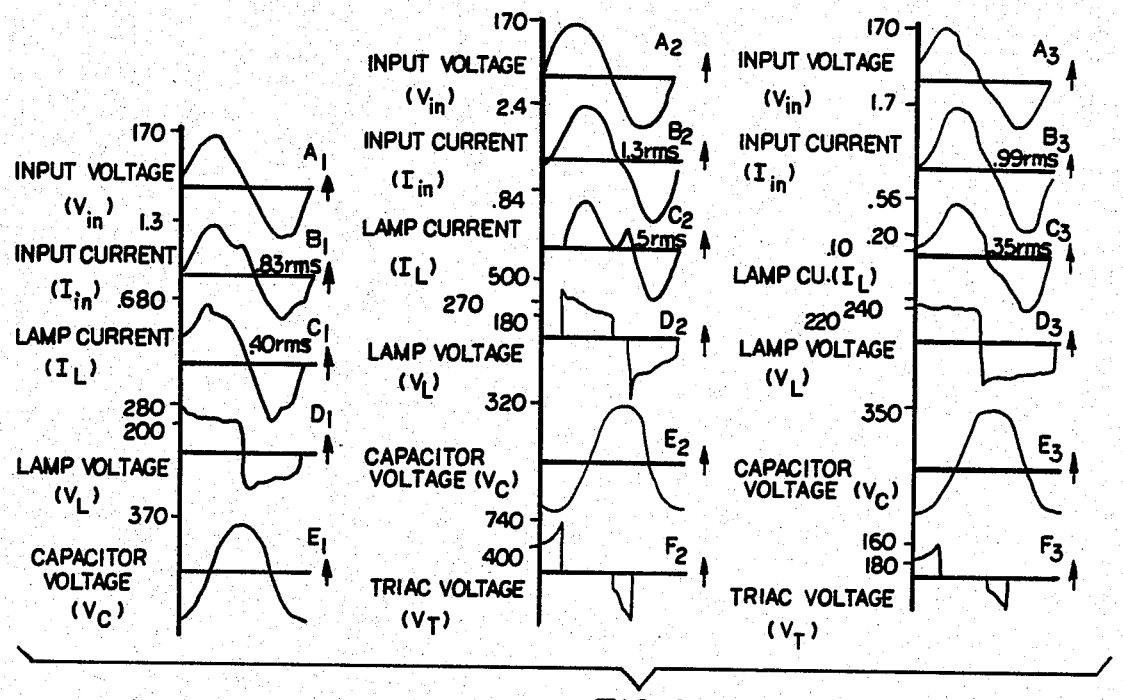
FIG. 4 compares voltage and current waveforms, at key circuit points, of the present inventive circuitry with other conventional lighting systems.

Accordingly, FIG. 4 illustrates voltage and current waveforms, shown as a function of time with arbitrary but comparative ordinate valves, for the control circuit of the present invention. These traces are shown in comparison to the conventional fluorescent lighting circuit illustrated in FIG. 1, and also shown in comparison to the invention's control system without the circulating inductor as taught herein.

Referring to FIG. 4, traces $B_1$, $B_2$ and $B_3$ compare input currents for the three aforementioned circuits. Although trace $B_3$ exhibits a higher peak input current than that of the non-controlled circuit of trace $B_1$, the input current of the present invention significantly lower than a comparable controlled circuit without such inductor, trace $B_2$.

Traces $C_1$, $C_2$ and $C_3$ compare lamp current for the three subject circuits. As illustrated in the traces, the lamp current for the present invention does not exhibit the fundamental current components which leads line voltage, trace $A_1$, in the conventional fluorescent lighting circuit. Traces $D_1$, $D_2$ and $D_3$ illustrate that lamp re-ignition voltage is lowest in the present invention. Furthermore, there is no dead band as in the case without the circulating inductor.

Referring to traces $E_1$ through $E_3$, it is noted that although the capacitor voltage is substantially identical for all three systems, the voltage waveform during the non-conducting periods of the controlled impedance for the present invention as illustrated in trace $E_3$, provides a means for capacitor voltage decay while the circuit without the circulating inductor illustrated in $E_2$ does not. This results in a substantially reduced voltage across the controlled impedance as illustrated in trace $F_2$ compared to the TRIAC voltage exhibited in trace $F_1$, whose ordinate scale is three times that used in trace $F_2$.

Figure 5:
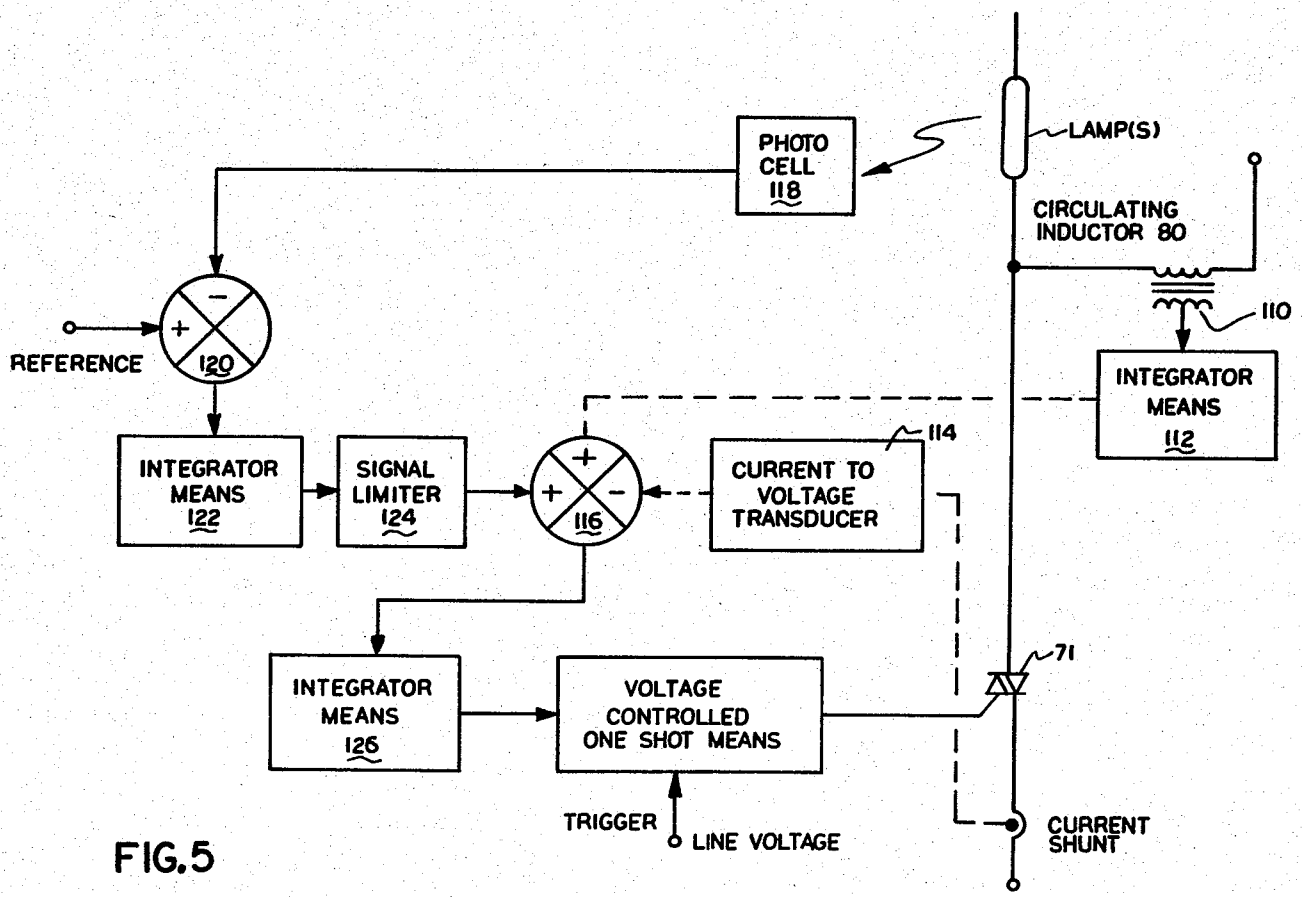
FIG. 5 illustrates, in block diagram format, the control circuit of the present invention.

Referring to FIG. 5, there is shown in block diagram format the control circuit for the current regulated modular lighting control with circulating inductor. Broadly stated, the control scheme consists of two feedback loops, a first loop controlling lamp current within the boundaries of a limiter, and a second loop controlling lighting intensity. The first loop sets lamp current to a specific value. This first loop is indicated in the figure by dashed line connections. In the embodiment illustrated, lamp current is monitored by sampling the current through TRIAC 71 and the voltage across a secondary winding of the circulating inductor 110. The voltage across winding 110 is integrated by integration means 112 to produce a voltage directly proportional to inductor current. This integrated voltage $V_1$ is subtracted from the voltage produced by current-to-voltage transducer 114, which produces a voltage $V_c$ proportional to a current monitored at the cathode of the controlled impedance 71. The subtraction of the voltage $V_c$ from $V_1$ by summing means 116 produces a signal which is a direct function of the lamp current, the parameter used in current regulation by the circuitry. The second feedback loop compares the output of a photocell generated signal to a reference signal. As illustrated in the figure, photocell 118 is positioned to intercept a portion of the irradiance from the gas discharge lamp, producing a signal which is proportional to the output illumination level of the lamp and some ambient level. Comparator means 120 compares the output of the photocell to a reference signal, $V_{reference}$. The reference signal may be established internally to the unit or by an external voltage reference circuit (not shown). The output of the comparator is fed into an integrator 122, which functions to attenuate responses caused by ambient lighting pertubations or the like. The output of the integrator means is coupled to signal limiter 124, which restricts the signal to boundaries within the dynamic range of a given lamp configuration. The first and second control signals produced by the first and second loop, respectively, are fed to summing means 116, which produces a differential signal, $V_{error}$ if any. The differential signal is coupled to integrator means 126, which integrates the differential signal with respect to time. This signal is coupled to the input of the voltage controlled one-shot means which controls the firing of the TRIAC 71. The output of the integrator 126 advances the timing of the voltage controlled one-shot means, which in turn advances the firing of the controlled impedance, TRIAC 71.

The operation of the control circuitry can be best illustrated by assuming that there is a positive error, $+V_{error}$, between the set point and the lamp current. The positive error causes the output of the integrator 126 to increase with time, which advances the timing of the voltage controlled one-shot. This in turn causes the TRIAC 71 to trigger earlier in the voltage cycle, increasing the current fed to lamps 12 and 14. When the differential signal from summing means 116 approaches zero ($V_{error}$ 0), the integrator means 126 signal ceases increasing, and the timing of the TRIAC firing during the voltage cycle remains unchanged.

Figure 6:
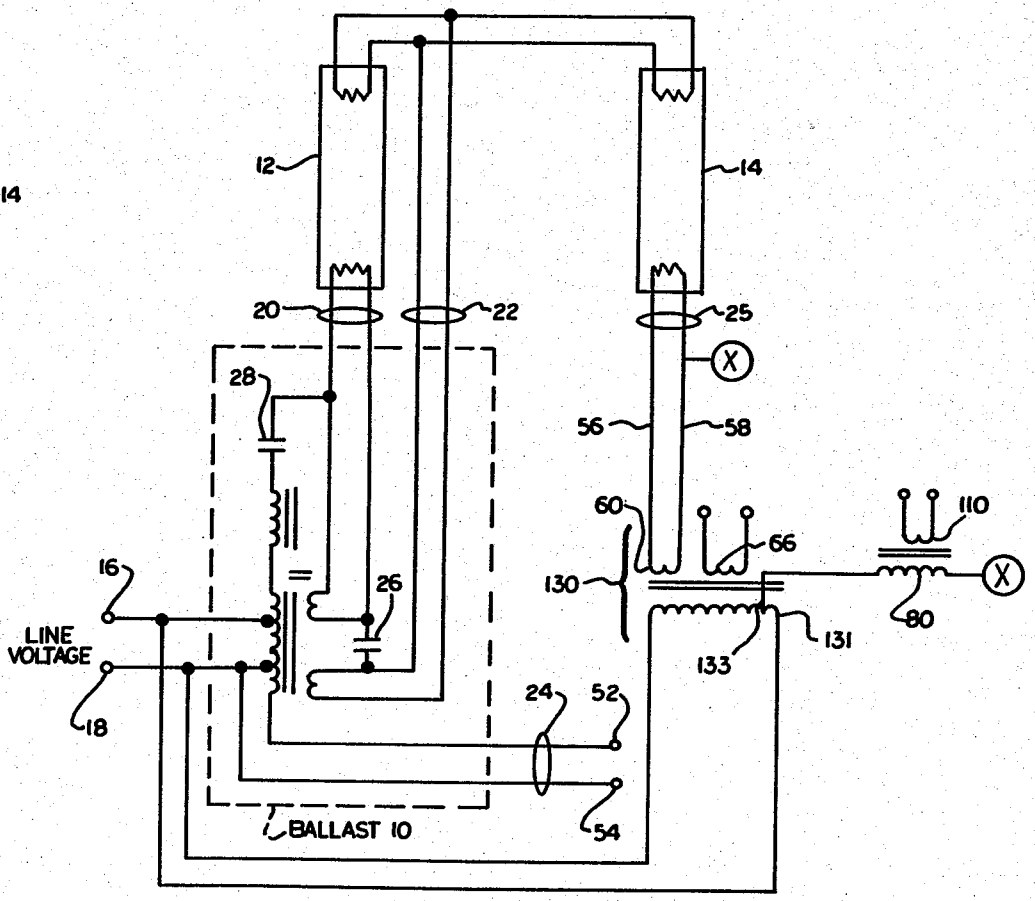
FIG. 6 illustrates an alternate embodiment of the circulating inductance aspect of the present invention.

Referring to FIG. 6, there is shown an alternative method for coupling the circulating inductor to the power mains of the ballast. Referring to FIG. 6, an isolation transformer 130 has its primary winding 131 coupled between input leads 16 and 18. The transformer includes a voltage tap 133 on the primary winding to which one lead of the circulating inductor 80 is coupled. This permits the circulating inductor 80 to be coupled to virtually any voltage up to the line voltage. For a standard magnetic voltage, the optimum tap voltage is about 90 volts. This voltage has been demonstrated to prevent lamp re-ignition when the controlled impedance is completely non-conducting. This minimizes the inductor's VA rating, yet permits full output when the controlled impedance is substantially conducted. An attendant advantage of the isolation transformer is a reduction in the blocking voltage requirements of the controlled impedance. Furthermore, it provides a means to permit the application of modular lighting control to any power main to achieve substantially identical load-side control in multiple lamp configurations.

Although illustrated heretofore as a two-lamp configuration, the present invention circuitry may be applied to four, or more, gas discharge lamp configurations. In its application to fluorescent lighting control, each two-lamp configuration includes a ballast substantially similar to that illustrated in FIG. 2 requiring a circulating inductor, controlled impedance, and control circuit for each ballast configuration.

Figure 7:
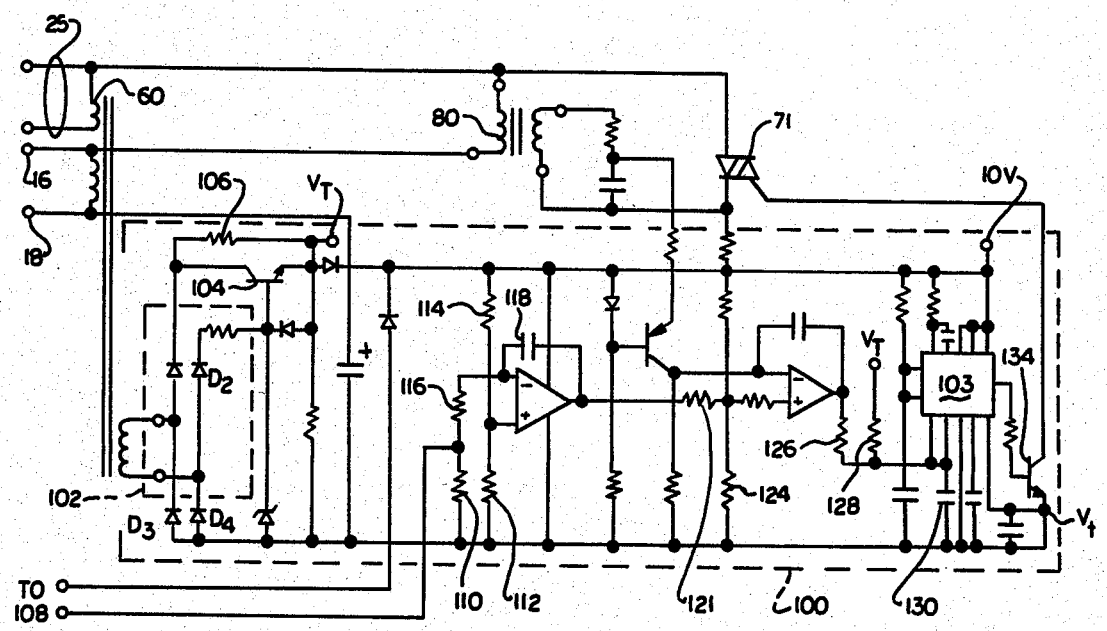
FIG. 7 illustrates a specific embodiment of the invention.

To assist one skilled in the art in the practice of the present invention, FIG. 7 illustrates a circuit diagram for specific embodiment and a two fluorescent lamp configuration for the modular lighting control with circulating inductor. The controlled impedance comprises TRIAC 71 having its main current conduction path coupled between gas discharge lamp lead pair 25 and the ballast input lead 18. The circulating inductor 80 is coupled between ballast input 16 and the anode electrode lead of TRIAC 71.

TRIAC electrode 72 is coupled to the control circuit collectively innumerated 100. A diode bridge 102 including diodes $D_1$ through $D_4$, provides rectified power for the control circuit and 60 Hertz synchronization for the one shots, discussed hereinafter. Transistor 104 and resistor 106 comprise a series regulator maintaining a given voltage for the control circuit supply, typically about 10 volts. A photocell 108 (not shown) is placed in a bridge configuration with resistors 110, 112 and 114. The reference for the bridge configuration may be set mechanically with a shutter mechanism covering the photocell from irradiation by the lamps or electronically by adjusting the bridge resistors themselves.

Resistor 116 and capacitor 118 form the integrator used in the second control loop. The output signal of the integrator is applied to a resistive network comprising resistors 121, 122 and 124. This resistor network comprises the signal limiter, the boundaries of which are set by the value of resistors 122 and 121 for the lower and upper boundaries, respectively. The output of the limiter is compared to the voltage representing half cycle lamp current, the measurement of which has been detailed heretofore. The difference is integrated and applied to a timing network which includes resistors 126, 128 and capacitor 130. An integrated circuit 103 comprises a dual timer arranged in two one-shot configurations. The first one-shot configuration is triggered by the zero crossing of line voltage; The second by the trailing edge of the first. The output of the second one-shot is coupled to the gate of transistor 134 where output is used to trigger TRIAC 80.

What is claimed is:

1. In a lighting installation of the type incorporating a magnetic ballast driven by a source of a power signal and having an output for providing power to at least one gas discharge lamp, a method for controlling the illumination of said at least one lamp comprising the steps of:

supplying a constant cathode heating power to the gas discharge lamp;

providing a controlled impedance at the output side of said ballast and in series with said at least one lamp, said controlled impedance having predefined conductive and non-conductive states;

during each cycle of said power signal, controlling the length of time which said controlled impedance remains in its conductive state in relationship to the desired illumination of said lamp; and providing a current conduction path during the length of time which said controlled impedance is in a non-conductive state by interposing an inductor between said source of power signal and said at least one gas discharge lamp.

2. The method of claim 1 further comprising the step of sensing the overall illumination in an area lighted by said installation and adjusting the conduction time of said controlled impedance to maintain said overall illumination in constant.

3. The method of claim 1 or 2 wherein the length of time of conduction is adjusted during each half-cycle of said power signal.

4. A circuit for controlling output illumination of a magnetic ballast, gas discharge lamp lighting system, said circuit comprising:

a controlled impedance having substantially conducting and non-conducting states, said impedance having its main current conduction path coupled between the gas discharge lamp and an output of the magnetic ballast;

means for controlling a period of conduction of said controlled impedance;

an inductor providing a current path between the output of the ballast and the gas discharge lamp during the non-conducting state of the controlled impedance.

5. The circuit of claim 4 wherein said means for controlling the conduction period comprises a timing means initiated by the start of each half-cycle of said power input signal and adjustable to indicate a selected delay beyond the start of each said half-cycle.

6. The circuit of claim 5 wherein said controlled impedance comprises a TRIAC.

7. The circuit of claim 4 wherein the lighting system comprises a pair of series connected gas discharge lamps.

8. The circuit of claim 7 wherein said ballast includes a plurality of windings adapted to be connected to cathodes of each of said lamps, said windings providing heating power each said lamp.

* * * * *